US011896066B1

(12) United States Patent
Baldwin

(10) Patent No.: US 11,896,066 B1
(45) Date of Patent: Feb. 13, 2024

(54) ARTICLE OF CLOTHING WITH MULTI-PURPOSE COVER ASSEMBLY

(71) Applicant: David Baldwin, Atlanta, GA (US)

(72) Inventor: David Baldwin, Atlanta, GA (US)

( * ) Notice: Subject to any disclaimer, the term of this patent is extended or adjusted under 35 U.S.C. 154(b) by 0 days.

(21) Appl. No.: 17/573,864

(22) Filed: Jan. 12, 2022

Related U.S. Application Data

(63) Continuation-in-part of application No. 16/737,133, filed on Jan. 8, 2020, now abandoned.

(51) Int. Cl.
*A41D 13/04* (2006.01)
*A41D 1/06* (2006.01)

(52) U.S. Cl.
CPC ..... *A41D 13/04* (2013.01); *A41D 1/06* (2013.01)

(58) Field of Classification Search
CPC ..... A41D 1/14
USPC ..... 2/48, 51, 247, 227, 46, 23
See application file for complete search history.

(56) References Cited

U.S. PATENT DOCUMENTS 564,373 A * 7/1896 Goodman ..... A41D 1/06 2/227
2,354,815 A * 8/1944 Murray ..... A41D 1/14 2/218
2,717,391 A * 9/1955 Bracken ..... A41D 13/0012 224/920
2,965,904 A * 12/1960 Johnson ..... A41D 1/14 2/211
3,848,267 A * 11/1974 DeSpain ..... A41D 13/04 224/577
5,829,056 A * 11/1998 Hubert ..... A41D 13/04 2/243.1
5,943,696 A * 8/1999 Walker ..... B44D 3/14 224/904
7,636,949 B1 * 12/2009 Shooshan ..... A45C 13/02 2/48
2004/0173484 A1 * 9/2004 Bates ..... B25H 3/04 206/349
2009/0049719 A1 * 2/2009 Compton ..... A41D 27/20 40/586
2018/0303172 A1 * 10/2018 King, Jr. ..... A41D 13/043
2020/0329791 A1 * 10/2020 McAteer ..... A41D 13/04

* cited by examiner

*Primary Examiner* — Heather Mangine
*Assistant Examiner* — Matthew R Marchewka
(74) *Attorney, Agent, or Firm* — John Rizvi; John Rizvi, P.A.—The Patent Professor®

(57) ABSTRACT

An article of clothing provides workers or users with a modifiable or transformable bottom garment which may be arranged in a functional, work configuration or a more aesthetic, non-work configuration by selectively folding a cover assembly downward or upward relative to the bottom garment. When folded downward, the cover assembly may reveal functional elements such as tool-supporting loops, pockets, etc., and/or may provide an inner surface for the wearer to clean their hands. When folded upward, a pocket is instead formed between the cover assembly and the bottom garment, for the wearer to warm their hands. One or more inserts may be connected to the downward-folded cover assembly to provide additional utilities or functions.

14 Claims, 14 Drawing Sheets

ARTICLE OF CLOTHING WITH MULTI-PURPOSE COVER ASSEMBLY

CROSS-REFERENCE TO RELATED APPLICATIONS

This application is a Continuation-In-Part of U.S. patent application Ser. No. 16/737,133, filed on Jan. 8, 2020, which is incorporated herein by reference in its entirety.

FIELD OF THE INVENTION

The present invention relates generally to articles of clothing, and more particularly, to an article of clothing with an upwardly and downwardly foldable accessory material to selectively provide workers with readily accessible functional elements or surfaces by folding the accessory material downward, and conceal the functional elements and surfaces by folding the accessory material upward, the upward folding also creating a top pocket for the wearer to warm his or her hands.

BACKGROUND OF THE INVENTION

Professionals such as construction workers, electricians, plumbers, nurses or other medical workers, veterinarians, etc. often must carry a plurality of tools while conducting their work. Because of this, these workers often wear specialized clothing providing a plurality of pockets or other tool-supporting elements or tool-storing spaces. However, unfortunately, this specialized clothing is often unaesthetic. Alternatively or additionally, the specialized clothing is clearly revealing of the worker's profession. For these reasons, such professionals will often need to commute to work wearing ordinary clothing, change into the specialized clothing at the work premises, and change back into the ordinary clothing after work, particularly if the professionals are heading somewhere other than home after work. This back and forth clothes' changing may be time consuming and inconvenient.

In another scenario, it is important in many occupations that when a worker gets dirty while working on their job or in any venue, they have a convenient way of cleaning themselves, particularly their hands. These occupations may include construction workers, factory workers, or any worker in that gets dirty.

Typically, the workers in these occupations may wipe their hands on their pants to clean their hands. It may also be important to have the capability of conveniently carrying one or more work related objects or items as well in their pair of pants.

Workers wiping their hands on their pants creates relatively higher laundry costs and also results in relatively higher replacement costs for replacing the severely soiled pants. With a relatively large company, this may result in additional operational costs for a company over time and specifically the long term.

It may also be impractical for these same workers to carry a cloth or other object that may be used to clean their hands. These items may also be cumbersome to carry in general and certainly may not be practical to carry while working on the job or in any venue doing relatively complex tasks.

Not having a convenient way for workers to clean or wipe their hands may also result in relatively higher downtimes from these same workers having to go to the bathroom several times per day to wash their hands. With many workers, this may result in increased downtime and increased overall production costs, which may also significantly impact a company's overall profits and bottom line.

Furthermore, not having a convenient way for workers to clean or wipe their hands may also result in relatively higher health insurance and healthcare costs for discouraged workers working the jobs that require them to wipe their hands during working situations that simply don't take the time to clean themselves leaving themselves vulnerable to injury. This may result in increased downtime and increased overall production costs, which may also significantly impact a company's overall profits and bottom line.

In addition, lacking having a convenient way for workers to clean or wipe their hands may also result in ethical dilemmas for companies. Not having a convenient way for workers to clean or wipe their hands may also result in decreased worker morale, resulting in sloppy and even dangerous conditions in a company.

Accordingly, there is an established need for a solution to at least one of the aforementioned problems. For example, there remains a need for a user to be able to discreetly wear working clothes when outside of work, in situations in which the user is not able to change into ordinary, non-work clothes. In another example, there remains a need for an article of clothing to provide workers with a convenient way of cleaning themselves while working on the job or any venue.

SUMMARY OF THE INVENTION

The present invention is directed to an article of clothing to provide workers with a modifiable or transformable bottom garment which may be arranged in a functional, work configuration or a more aesthetic, non-work configuration by selectively folding a cover assembly downward or upward relative to the bottom garment. When folded downward, the cover assembly may reveal functional elements such as tool-supporting loops, pockets, etc., and/or may provide an inner surface for the wearer to clean their hands. When folded upward, a pocket is instead formed between the cover assembly and the bottom garment, for the wearer to warm their hands. One or more inserts may be connected to the downward-folded cover assembly to provide additional utilities or functions.

In a first implementation, an article of clothing may include a bottom garment, a cover assembly and at least one fastener. The cover assembly may be pivotably affixed to the bottom garment along a hinge portion, the hinge portion arranged oppositely to a free edge of the cover assembly. The article of clothing may be configured to selectively adopt a first configuration and a second configuration. In the first configuration, the cover assembly may be folded upward about the hinge portion, with the free edge of the cover assembly arranged above the hinge portion; the cover assembly may cover an upper area of the bottom garment and may be secured in place by the at least one fastener; furthermore, a top pocket may be defined between the cover assembly and the upper area of the bottom garment, the top pocket ending in a top opening formed between the free edge of the cover assembly and the bottom garment. In the second configuration, the cover assembly may be folded downward about the hinge portion, with the free edge of the cover assembly arranged below the hinge portion; and the upper area of the bottom garment may be exposed.

In a second aspect, the cover assembly may be provided on a front side of the bottom garment.

In another aspect, the cover assembly may be provided on a rear side of the bottom garment.

In another aspect, the at least one fastener may be configured to secure at least one of a left side and a right side of the cover assembly to the bottom garment in the first configuration.

In another aspect, the at least one fastener may include a respective zipper arranged on each one of the left side and the right side of the cover assembly and configured to secure said each one of the left side and the right side to the bottom garment in the first configuration.

In yet another aspect, the at least one fastener may include a pair of discrete fasteners configured to secure a top left area and a top right area of the cover assembly to the bottom garment in the first configuration. The top opening may be formed between the pair of discrete fasteners.

In another aspect, the article of clothing may further include a bottom pocket provided on the bottom garment. The bottom pocket may be arranged below and facing the top pocket when the article of clothing is arranged in the first configuration. The bottom pocket may be accessible through a bottom pocket opening.

In another aspect, the article of clothing may further include at least one bottom pocket fastener configured to selectively open or close the bottom pocket opening.

In another aspect, the at least one bottom pocket fastener may be concealed by the cover assembly when the article of clothing is arranged in the first configuration.

In yet another aspect, the at least one bottom pocket fastener may be exposed when the article of clothing is arranged in the second configuration.

In another aspect, the at least one bottom pocket fastener may include a zipper.

In another aspect, the article of clothing may further include at least one functional element on an inner side of the cover assembly. The inner side and the at least one functional element may be concealed when the article of clothing is arranged in the first configuration. The inner side and the at least one functional element may be exposed rendering the functional element usable when the article of clothing is arranged in the second configuration.

In another aspect, the at least one functional element may include one or more loops configured for the suspending therefrom of one or more tools.

In yet another aspect, the at least one element may include one or more light-reflective materials.

In another aspect, the article of clothing may further include at least one insert. Each insert may be selectively and disconnectably attachable to one or more of the cover assembly and the upper area of the bottom garment when the article of clothing is arranged in the second configuration.

In another aspect, the at least one insert may include two or more inserts providing different functional utilities to the article of clothing.

In another aspect, the at least one insert may be mountable to the at least one fastener.

In yet another aspect, the article of clothing may include one or more additional fasteners provided on at least one of the upper area of the bottom garment and an inner side of the cover assembly, wherein the inner side is exposed when the article of clothing is arranged in the second configuration. The at least one insert may be attachable to the one or more additional fasteners.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward an article of clothing to provide users, such as workers, with a modifiable or transformable bottom garment which may be arranged in a functional, work configuration or a more aesthetic, non-work configuration by selectively folding a cover assembly downward or upward relative to the bottom garment.

Figure 1:
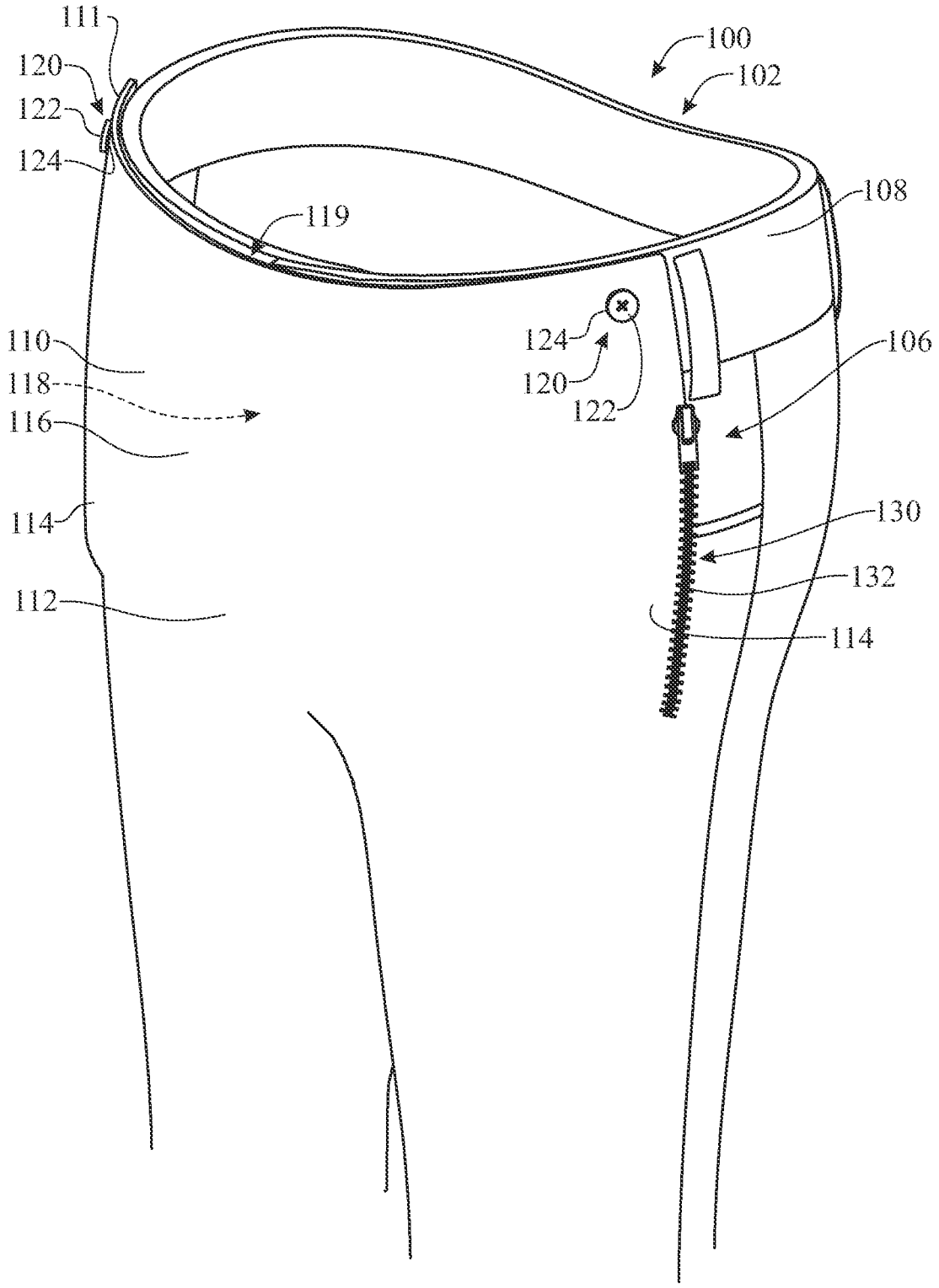
FIG. 1 presents a perspective view of an article of clothing with an accessory material in a front raised configuration, in accordance with a first illustrative embodiment of the present invention.
Figure 2:
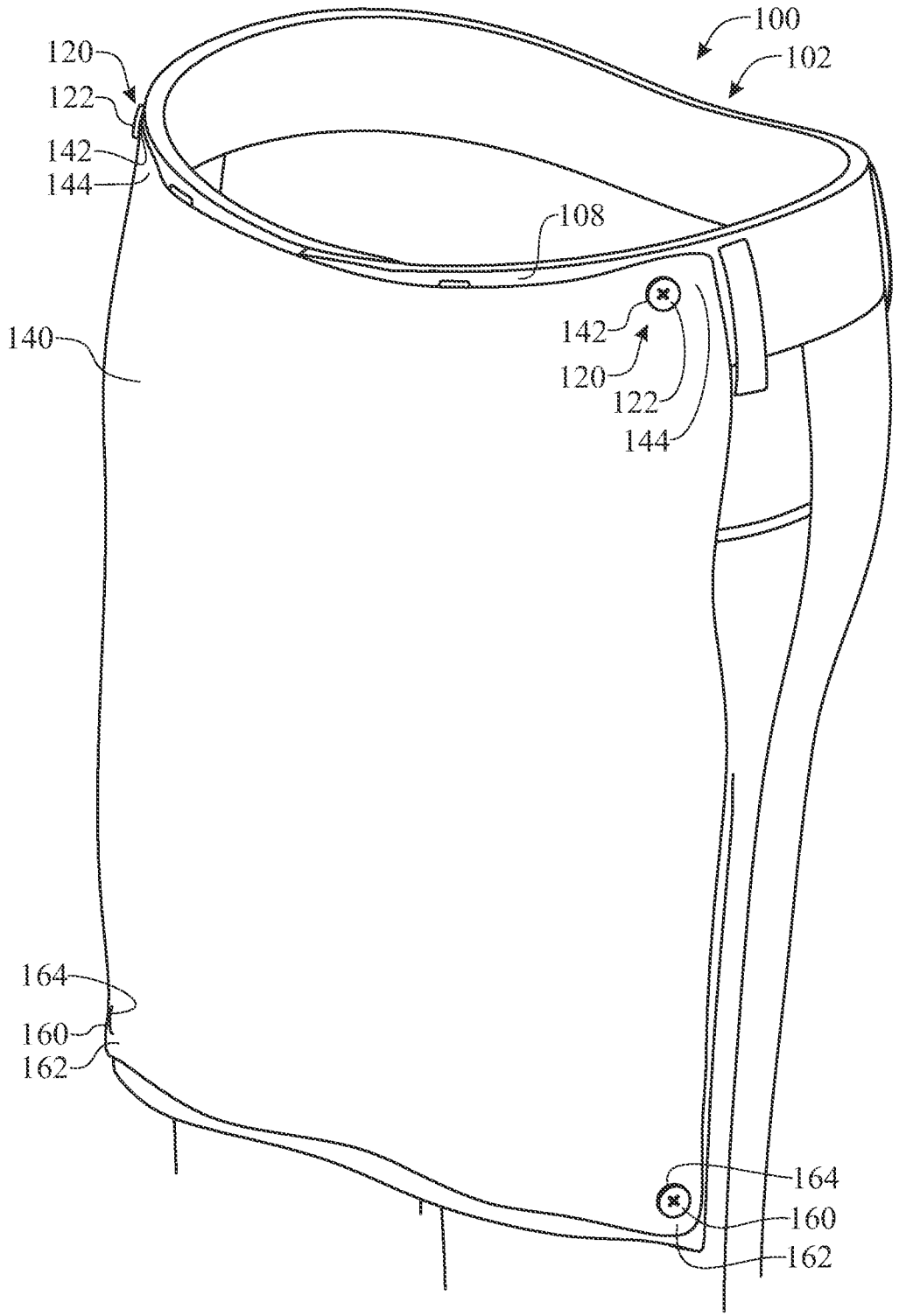
FIG. 2 presents a perspective view of an article of clothing with an accessory material in a front lowered configuration, in accordance with a first illustrative embodiment of the present invention.

Referring now to FIGS. 1 and 2, an article of clothing 100 is illustrated in accordance with a first exemplary embodiment of the present invention. The article of clothing 100 includes a pair of pants 102. As shown in FIG. 1, the article of clothing 100 of the present embodiment further includes a cover assembly or first accessory material 110, at least one first fastener 120, and at least one second fastener 130. The first accessory material 110 may be formed as a relatively flat body, panel or sheet, and may be made of fabric, paper, fibers, microfiber and/or other preferably flexible material(s). As shown, the first accessory material 110 may be integrally formed with the pair of pants 102 and foldable upward and downward about a hinge portion 112 to adopt, respectively, an upward position or raised configuration (FIG. 1) and a downward position or lowered configuration (FIG. 2). In the raised configuration of FIG. 1, the first accessory material 110 may be configured to cover at least some of the waist portion of the pair of pants 102. In the lowered configuration of FIG. 2, the first accessory material 110 may be configured to cover at least some of the leg portion of the pair of pants 102. Both the raised configuration and the lowered configuration may provide functional utility for the person wearing the article of clothing 100 such as allowing a person to conveniently clean their hands.

As further shown in FIG. 1, the first accessory material 110 may be folded upward to adopt the raised configuration, in which the first accessory material 110 may serve as a cover protecting the front of the pair of pants 102 (e.g., one or more pockets therein), and/or allow a user to wipe their hands on a front side 116 of the first accessory material 110. The first accessory material 110 may be secured in the raised configuration to a front portion 104 of the pair of pants 102 by the aforementioned at least one first fastener 120 and at least one second fastener 130. In some embodiments, the at least one first fastener 120 may include, for instance and without limitation, one or more of a zipper, a hook and loop fastener, a magnetic fastener, a button, or a snap fastener. For instance, in the present embodiment, the at least one first fastener 120 includes a pair of top buttons 122 disposed on a top seam 108 at the front portion 104 of the pair of pants 102. The buttons 122 are inserted through a pair of corresponding apertures 124 disposed on a pair of upper corners 126 of the first accessory material 110 to couple the first accessory material 110 in the raised configuration. In turn, the at least one second fastener 130 may be disposed between one or both lateral sides 114 of the first accessory material 110 and the front portion 104 of the pair of pants 102 that couples the front side 116 of the first accessory material 110 and the front portion 104 of the pair of pants 102. In some embodiments, the at least one second fastener 130 may include, for instance and without limitation, one or more of a zipper, a hook and loop fastener, a magnetic fastener, a button, or a snap fastener.

In the raised configuration of FIG. 1, as shown, a top pocket 118 is defined between the cover assembly or first accessory material 110 and the upper area of the pair of pants 102 (the upper area being the area which is covered by the raised, first accessory material 110). The top pocket 118 ends in a top opening 119 formed between a top, free edge 111 of the cover assembly or first accessory material 110 and the pair of pants 102. In the present embodiment, as shown, the top opening 119 is formed between the pair of first fasteners 120.

As mentioned heretofore, FIG. 2 illustrates the article of clothing 100 with the first accessory material 110 folded downward to adopt the lowered configuration. In this lowered configuration of the first accessory material 110, the first accessory material 110 may reveal (i.e. no longer cover) a front of the pair of pants 102, such as to allow access to items contained in pockets thereof. Furthermore, the lowered, first accessory material 110 may be used as a suspended fabric or cloth on which the user can clean their hands, tools, etc.

In some embodiments, as shown, the article of clothing 100 may include a second accessory material 140 formed as a separate piece which can be attached to the pair of pants 102 and to the first accessory material 110. The second accessory material 140 may be formed as a relatively flat body, panel or sheet, and may be made of fabric, paper, fibers, microfiber and/or other preferably flexible material(s). As shown, the second accessory material 140 may be configured to wrap around or cover a waist and leg portion of a person wearing the article of clothing 100 and cover the first accessory material 110 in the lowered configuration. The second accessory material 140 may adopt a vertically extended position and may be coupled to the article of clothing 100 by the pair of top buttons 122 disposed on the top seam 108 of the pair of pants 102 inserted through a pair of corresponding upper apertures 142 on a pair of upper corners 144 of the second accessory material 140, and by a pair of lower buttons 160 disposed on a pair of lower corners 162 of the first accessory material 110 inserted through a pair of corresponding lower apertures 164 on a pair of lower corners 166 of the vertically extended second accessory material 106. As shown, when the second accessory material 106 is attached to the first accessory material 110 and pair of pants 102 in this vertically extended position, the second accessory material 140 provides a vertically extended cloth on which the person wearing the article of clothing 110 may clean their hands. Once the second accessory material 106 becomes soiled, it may be detached from the pair of pants 102 by disconnecting the buttons 122, 160 and washed separately of the pair of pants 102. In addition, the disconnectable second accessory material 106 allows the person to clean their hands on the second accessory material 106 separated from the article of clothing 100. Furthermore, the user may own or be provided with several second accessory materials 106 which may be interchangeably attached to the pair of pants 102 as described. In some embodiments, the one or more second accessory materials 106 may be disposable (e.g., made of paper or paper-based cloth).

Figure 3:
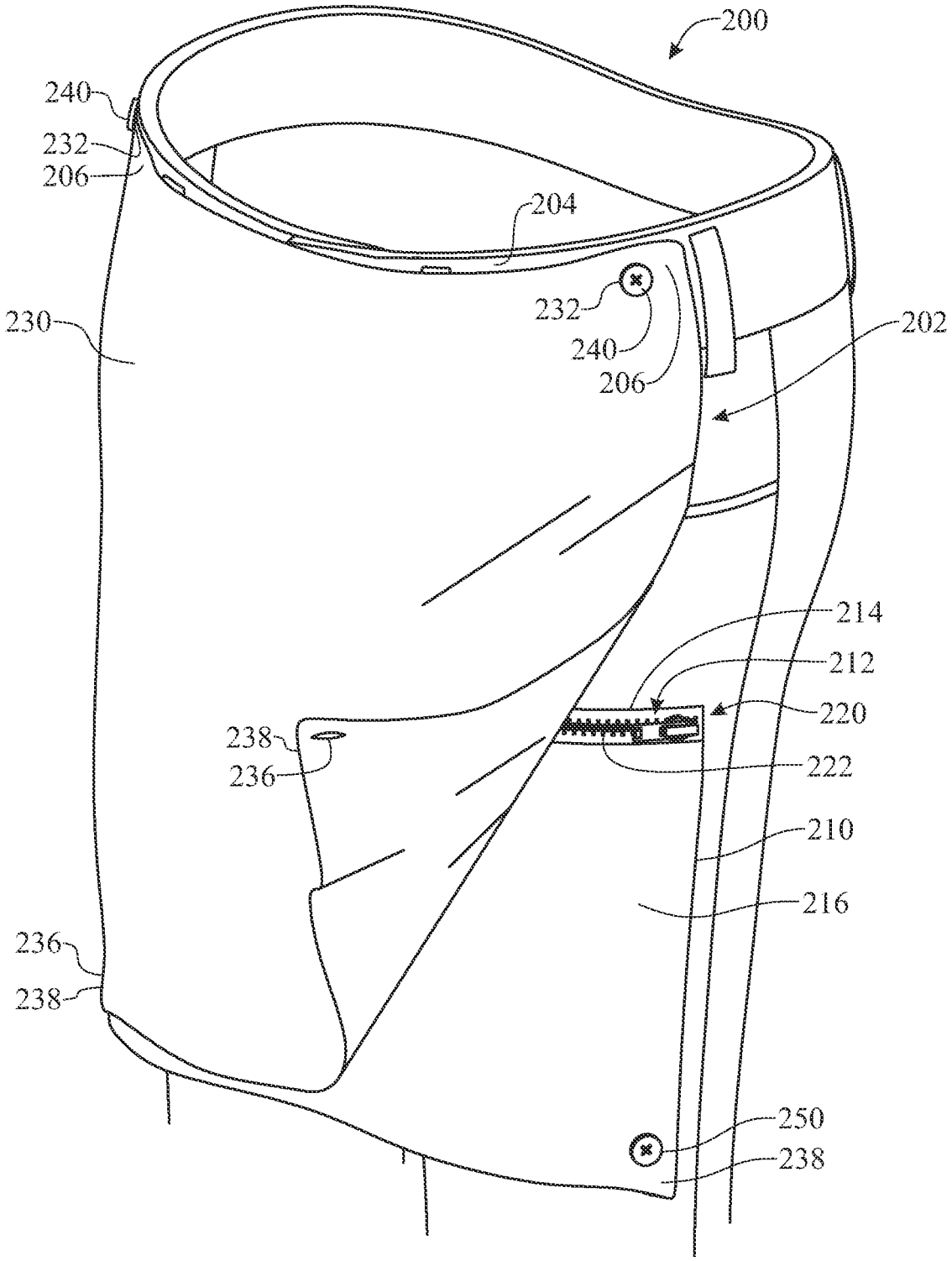
FIG. 3 presents a perspective view of an article of clothing with an accessory material in a front lowered configuration and a pocket, in accordance with a second illustrative embodiment of the present invention.
Figure 4:
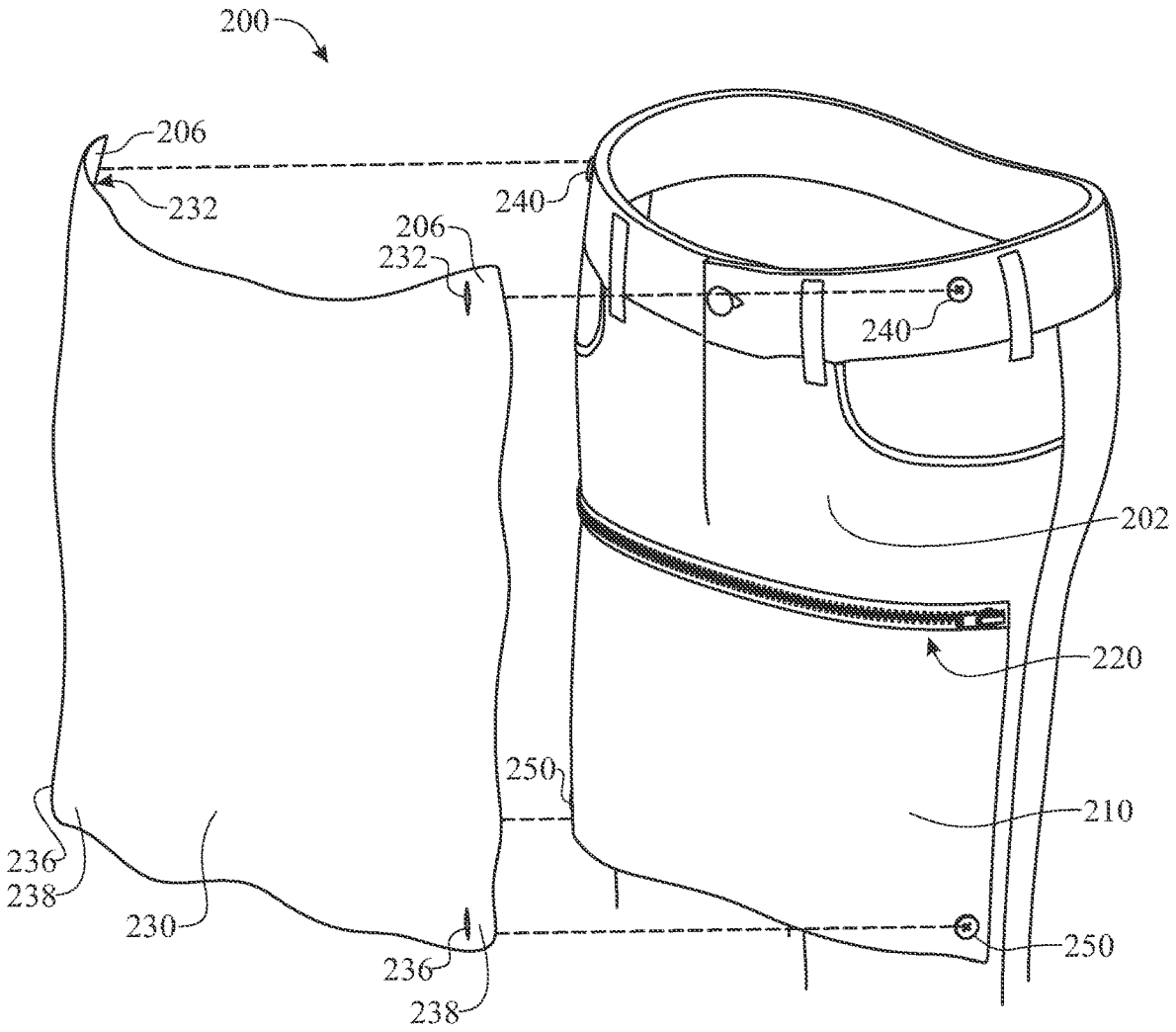
FIG. 4 presents a perspective, expanded view of an article of clothing with an accessory material in a front lowered configuration and a pocket, in accordance with a second illustrative embodiment of the present invention.
Figure 5:
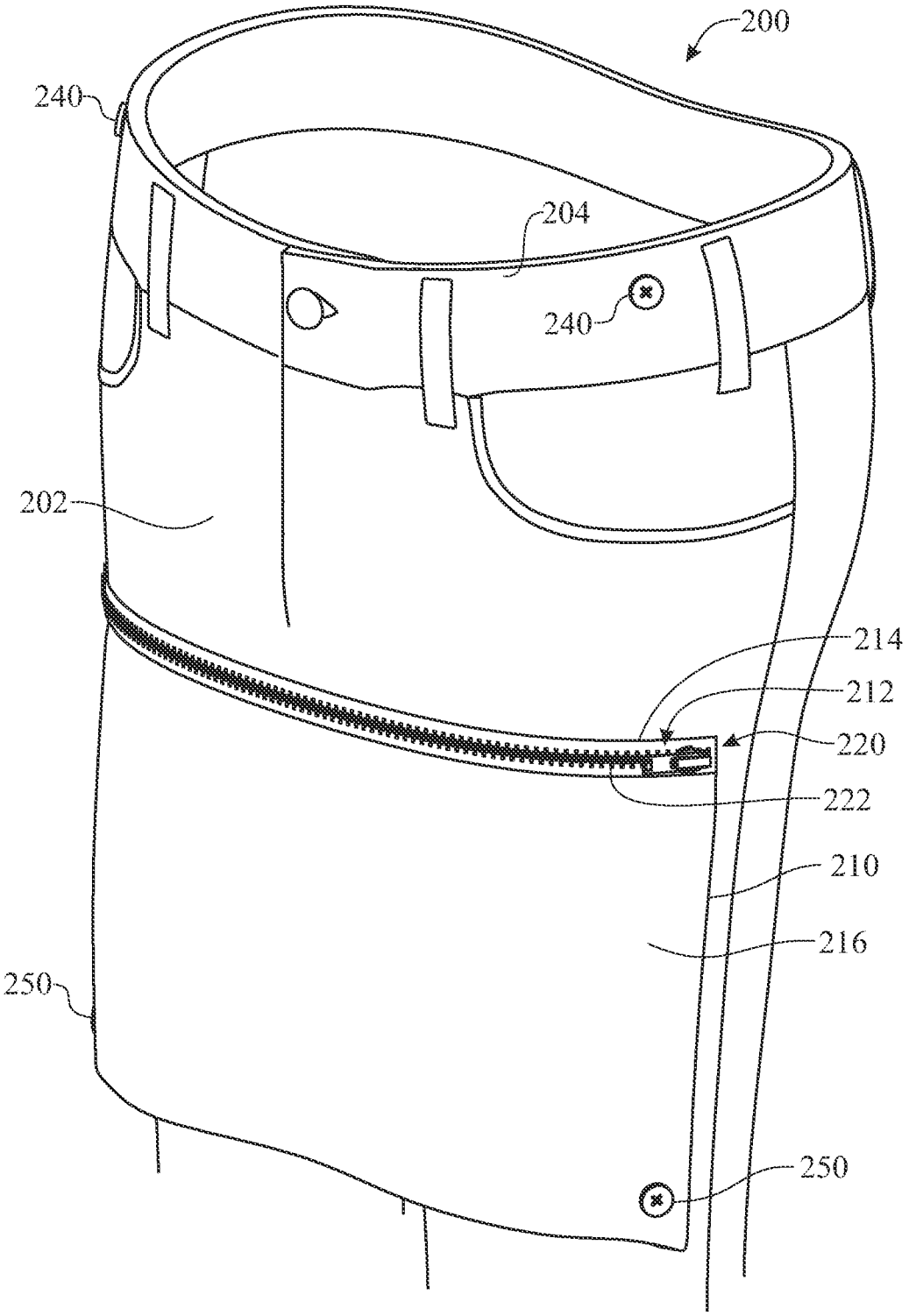
FIG. 5 presents a perspective view of an article of clothing with a pocket, in accordance with a second illustrative embodiment of the present invention.

The illustrations of FIGS. 3-5 present a perspective view of an article of clothing 200 in accordance with a second illustrative embodiment of the present invention. As best shown in FIG. 4, the article of clothing 200 may include a pocket 210, which may be disposed on a front portion 202 of the article of clothing 200, such as covering a leg portion of a person wearing the article of clothing 200. The article of clothing 200 may further include an accessory material 230 which is connectable and disconnectable to a front side of the pair of pants. The accessory material 230 may be formed as a relatively flat body, panel or sheet, and may be made of fabric, paper, fibers, microfiber and/or other preferably flexible material(s).

As shown in FIG. 5, the accessory material 230 may be detached and removed, revealing the pocket 210, which may be suspended or otherwise attached to a front side of the article of clothing 200. The pocket 210 may contain one or more work related items such as a hammer, screwdriver, etc., at least one first fastener 220, a pair of top buttons 240, and a pair of bottom buttons 250. The pocket 210 may include at least one opening 212, preferably arranged on a top portion 214 of a front side 216 of the pocket 210. The opening 212 provides access to the interior of the pocket 210 to insert or remove items into or from the pocket 210. The opening 212 may be closed by at least one first fastener 220. The at least one first fastener 220 may include one or more of a zipper 222, a magnetic fastener, a snap fastener, a hook and loop fastener, a button, etc.

It should be noted that, similarly to the previous embodiment, the disconnected accessory material 230 is such that the person may clean their hands on the accessory material 230 separated from the article of clothing 200.

As shown in FIGS. 3 and 4, the accessory material 230 may adopt a vertically extended position in which it wraps around or covers a front portion of a waist and leg portion of a person wearing the article of clothing 200, preferably covering the pocket 210. The accessory material 230 may be coupled to the article of clothing 200 with the pair of top buttons 240 disposed on a top seam 204 of the article of clothing 200 inserted through a pair of corresponding upper apertures 232 on a pair of upper corners 206 of the vertically extended accessory material 230 and through a pair of lower buttons 250 disposed on a pair of lower corners of the pocket 210 inserted through a pair of corresponding lower apertures 236 on a pair of lower corners 238 of the vertically extended accessory material 230 to couple the accessory material 230 in position to allow the person to clean their hands on the accessory material 230.

Figure 6:
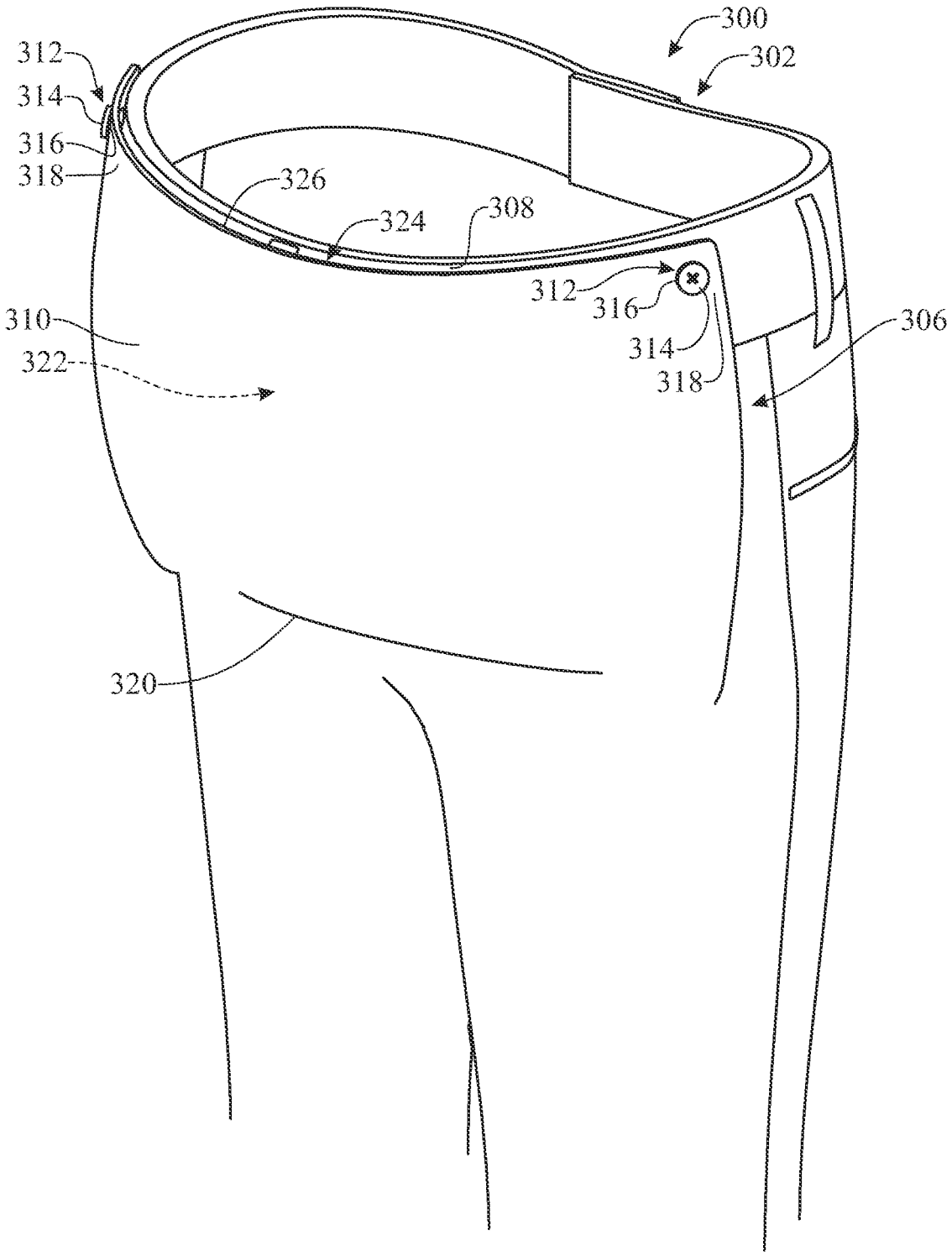
FIG. 6 presents a perspective view of an article of clothing with an accessory material in a rear raised configuration, in accordance with a third illustrative embodiment of the present invention.

Referring now to FIG. 6, an article of clothing 300 in accordance with a third embodiment of the present invention is illustrated. The article of clothing 300 is similar to the first embodiment of FIGS. 1 and 2 in that it is also configured as a pair of pants 302 and includes a cover assembly or accessory material 310 formed as a downwardly-foldable panel attached to the pair of pants 302. However, the article of clothing 300 of the present embodiment is different in that the accessory material 310 is arranged at a rear portion 306 of the pair of pants 302. It must be noted that, similarly to other embodiments, the article of clothing 300 illustrated in FIG. 6 is a pair of pants but may be any suitable article of clothing.

Similarly to other embodiments, the accessory material 310 may adopt a raised configuration, shown in FIG. 6, in which the accessory material 310 may cover pockets on the rear side of the pair of pants 302 and/or may provide a rear, outside surface on which the user may wipe their hands. Also similarly to other embodiments, the accessory material 310 may adopt a lowered configuration in which it is folded downward about a hinge portion or fold area 320 and becomes suspended from the pair of pants 302. In this lowered configuration, the suspended accessory material 310 provides a surface on which the user can clean their hands.

When folded upward, the accessory material 310 may be secured to the rear portion 306 of the article of clothing 300 by at least one fastener 312. The at least one fastener 312 may include a pair of top buttons 314 disposed on a top seam 308 of the rear portion 306 of the pair of pants 302 inserted through a pair of corresponding apertures 316 disposed on a pair of upper corners 318 of the first accessory material 300. Alternatively or additionally, the at least one fastener 312 may include one or more of a button, a magnetic fastener, a snap fastener, a hook-and-loop fastener, etc.

In the raised configuration, as shown, a top pocket 322 is defined between the cover assembly or accessory material 310 and the upper area of the pair of pants 302 (the upper area being the area which is covered by the raised, accessory material 310). The top pocket 322 ends in a top opening 324 formed between a top, free edge 326 of the cover assembly or accessory material 310 and the pair of pants 302. In the present embodiment, as shown, the top opening 324 is formed between the pair of top buttons 314.

Figure 7:
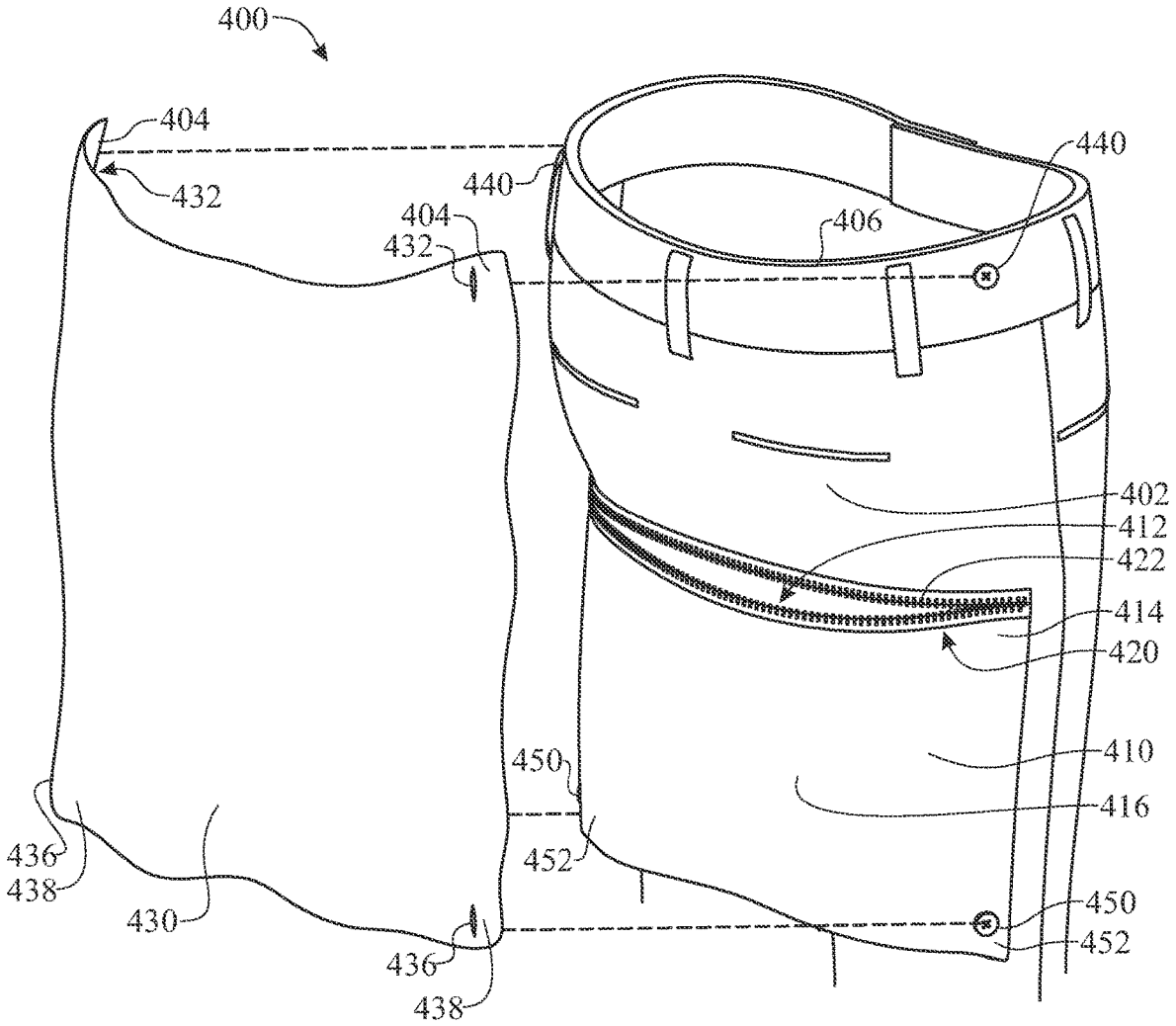
FIG. 7 presents a perspective, expanded view of an article of clothing with an accessory material in a rear lowered configuration and a pocket, in accordance with a fourth illustrative embodiment of the present invention.
Figure 8:
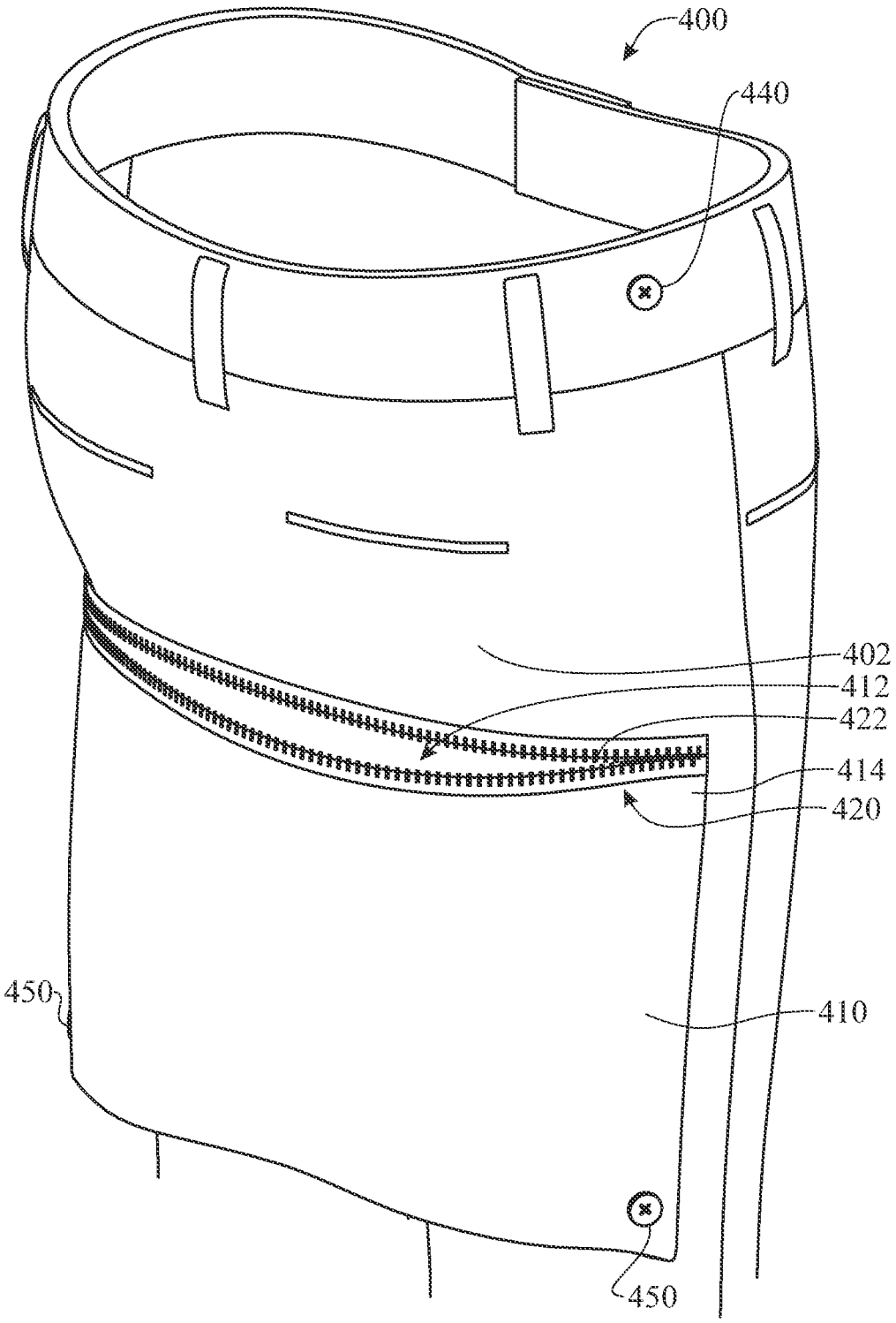
FIG. 8 presents a perspective view of an article of clothing with a pocket, in accordance with a fourth illustrative embodiment of the present invention.

The illustrations of FIGS. 7 and 8 present an article of clothing 400 in accordance with a fourth illustrative embodiment of the present invention. The article of clothing 400 is configured as a pair of pants, and may include a pocket 410, at least one first fastener 420, an accessory material 430, a pair of top buttons 440, and a pair of lower buttons 450. The pocket 410 may include an opening 412 on a top portion 414 of a front side 416 of the pocket 410. Unlike the embodiment of FIGS. 4 and 5, the pocket 410 of the present embodiment is disposed on a rear portion 402 of the pair of pants, covering a leg portion of a person wearing the article of clothing 400. The pocket 410 may contain one or more work related items or tools, which may be inserted and removed into and from the pocket 410 through the opening 412. At one first fastener 420 may be provided at the opening 412 to close the opening 412 or, alternatively, allow access to the opening 412. The at least one first fastener 420 may include one or more of a zipper 422, snap fastener, button, magnetic fastener, hook-and-loop fastener, etc.

As shown in FIG. 7, the accessory material 430 may be formed as a relatively flat body, panel or sheet, and may be made of fabric, paper, fibers, microfiber and/or other preferably flexible material(s), and may adopt a raised configuration in which the accessory material 430 is vertically extended and may be configured to wrap around or cover a front portion of a waist and leg portion of a person wearing the pair of pants and covering the pocket 410. The accessory material 430 may be coupled to the pair of pants by the pair of top buttons 440 disposed on a top seam 406 of the pair of pants inserted through a pair of corresponding upper apertures 432 on a pair of upper corners 404 of a vertically extended accessory material 430 and through a pair of lower buttons 450 disposed on a pair of lower corners 452 of the pocket 410 inserted through a pair of corresponding lower apertures 436 on a pair of lower corners 438 of the vertically extended accessory material 430 to couple the accessory material 430 in position to allow the person to clean their hands on the accessory material 430.

As shown in FIG. 8, the article of clothing 400 of the present embodiment may also be used without the accessory material 430. I.e., the accessory material 430 may be uncoupled and removed to allow the person to clean their hands on the accessory material 430 separated from the article of clothing 400, and/or to allow to insert or remove items into or from the pocket 410.

Figure 9:
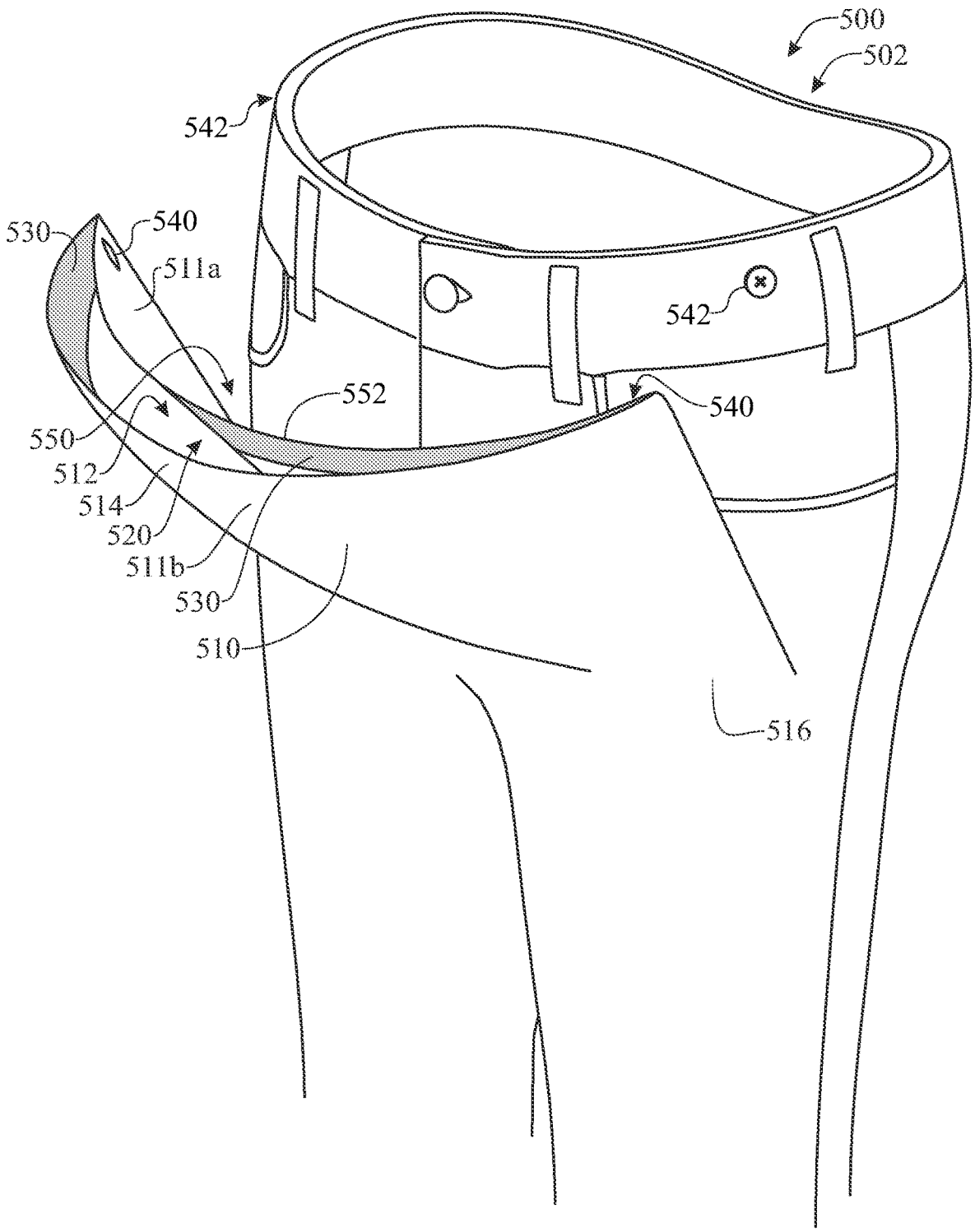
FIG. 9 presents a perspective view of an article of clothing with an accessory material in a partially front lowered configuration, in accordance with a fifth illustrative embodiment of the present invention.

The illustration of FIG. 9 presents an article of clothing 500 in accordance with a fifth illustrative embodiment of the present invention. The article of clothing 500 is formed as a pair of pants 502 and includes a cover assembly or accessory material 510, which is shown in a partially lowered configuration. The accessory material 510 may include several relatively flat bodies, panels or sheets, which may be made of fabric, paper, fibers, microfiber and/or other preferably flexible material(s). As can be seen, the accessory material 510 of the present embodiment specifically includes an inner panel 511*a* and an outer panel 511*b* which are connected to each other on lateral sides thereof, thereby forming a pocket 520. The pocket 520 has an interior 512 which may receive one or both hands of the user to warm the hands, and/or may be used to house items such as, but not limited to, papers, cards, etc. At least one hook and loop fastener 530, magnetic fastener, button, snap fastener, and/or other fastener may be disposed across a top portion 514 of the accessory material 510 to partially or entirely close the pocket 520 and retain one or more work related items within the interior 512 of the pocket 520.

Similarly to previous embodiments, the accessory material 510 may be foldable upward and downward about a hinged portion 516 to adopt a raised configuration and a lowered configuration. The illustration shows the accessory material 510 partially raised (or partially lowered). As shown, the accessory material 510 may include two top apertures 540 configured to be connected to a pair of top buttons 542 in the front area of the pair of pants 502. In different embodiments, as has been similarly discussed heretofore with reference to previous embodiments, alternative or additional fasteners may be used to close the pocket 520 and to attach the accessory material 510 in the raised configuration. For instance, fasteners such as, but not limited to, magnetic fasteners or snap fasteners may be used.

Similarly to previous embodiments, in the raised configuration, a top pocket 550 is defined between the cover assembly or accessory material 510 and the upper area of the pair of pants 502 (the upper area being the area which is covered by the accessory material 510 once raised to the upright position and secured in place by the pair of top buttons 542). The top pocket 550 ends in a top opening formed between a top, free edge 552 of the cover assembly or accessory material 510 and the pair of pants 502. As with previous embodiments, the top opening is formed between the pair of top buttons 542.

Alternative embodiments are contemplated to those described and/or depicted herein without departing from the scope of the present disclosure. For instance, in some embodiments, the accessory materials may be reflective or non-reflective.

The illustrations of FIG. 10-13 show an article of clothing 600 in accordance with a further embodiment of the invention. Similarly to previous embodiments, such as, but not limited to, the articles of clothing 100, 300, 500 described heretofore, the article of clothing 600 of the present embodiment includes a bottom garment 602 configured to cover a bottom area of the wearer's body. For instance, in the present embodiment, the bottom garment 602 consists of a pair of pants. The article of clothing further includes a cover assembly 610. The cover assembly 610 is pivotably affixed to the bottom garment 602 along a hinge portion 612. Similarly to the articles of clothing 100, 300 and 500, in the present embodiment, the cover assembly 610 is integrally made with the bottom garment 602 and extends from the bottom garment 602 at the hinge portion 612, which pivotably interconnects the cover assembly 610 to the bottom garment 602, the hinge portion 612 arranged oppositely to a free edge 614 of the cover assembly 610.

Also similarly to previous embodiments, the article of clothing 600 further includes at least one fastener 620, configured to secure the cover assembly 610 in a raised position as will be described in greater detail hereinafter. Each fastener 620 may include a first fastener member 622 carried by the bottom garment 602 and a second fastener member 624 carried by the cover assembly 610, the first and second fastener members 622 and 624 configured to disconnectably attach to one another. For instance, the present embodiment includes two fasteners 620, wherein the first fastener member 622 of each fastener 620 consists of a button attached to the bottom garment 602, and the second fastener member 624 of each fastener 620 consists of a slit formed in the cover assembly 610. Alternatively or additionally, the article of clothing may include fasteners 620 such as, but not limited to, a zipper, a snap fastener, a magnetic fastener, a hook-type fastener, or combinations thereof. For example, the articles of clothing 100, 300 and 500 respectively include the top buttons 122 and side zippers 132 (FIG. 1), the pair of top buttons 314 (FIG. 6), and the pair of top buttons 542 (FIG. 9).

Figure 10:
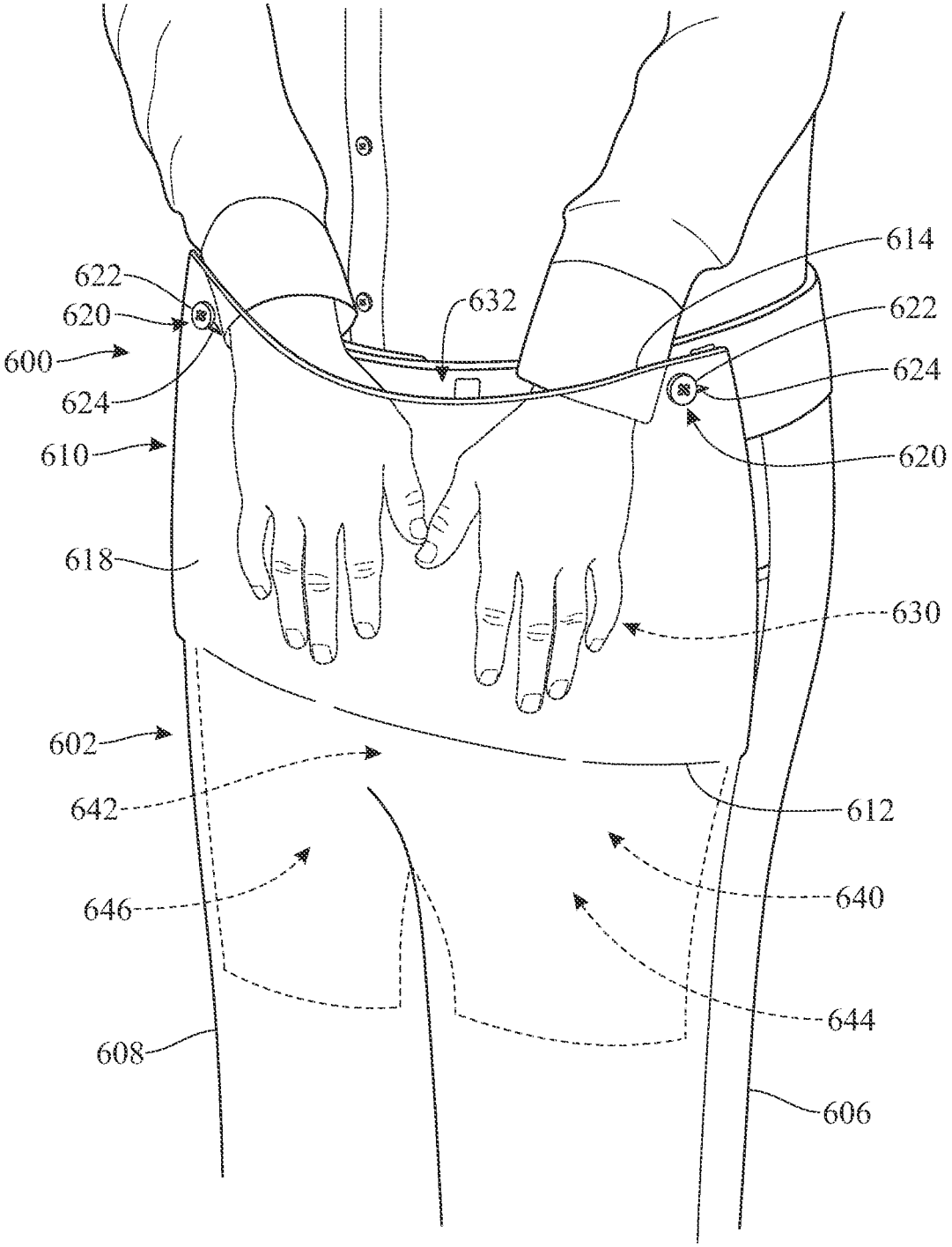
FIG. 10 presents a perspective view of an article of clothing with an accessory material or cover assembly in a first configuration, in accordance with a sixth illustrative embodiment of the present invention, further illustrating a wearer's hands being placed in a top pocket formed between the cover assembly and the bottom garment or pair of pants.
Figure 11:
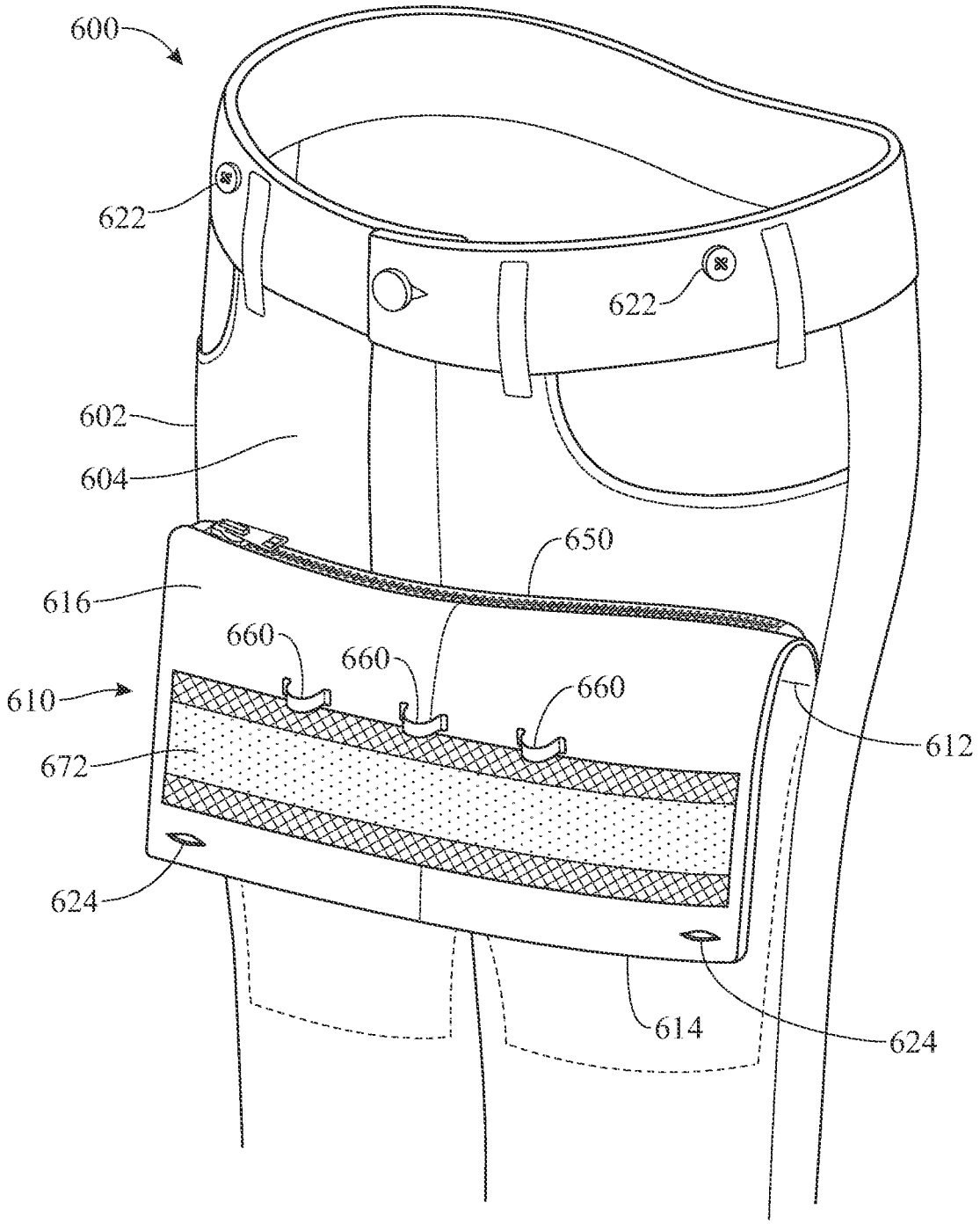
FIG. 11 presents a perspective view of the article of clothing of FIG. 10 in a second configuration, with the cover assembly folded downward and a bottom pocket fastener shown in a closed position.
Figure 12:
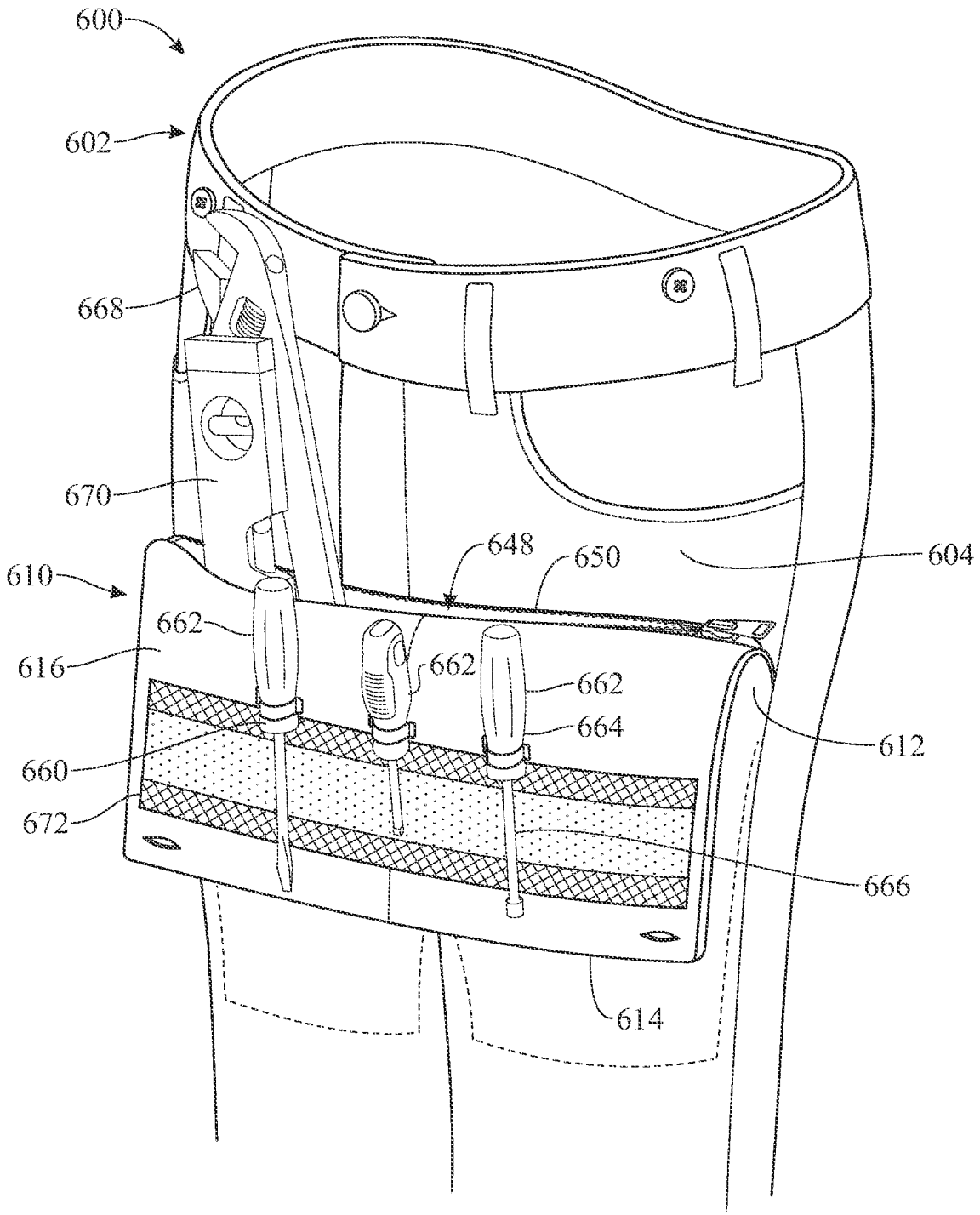
FIG. 12 presents a perspective view of the article of clothing of FIG. 10 in the second configuration, further illustrating the bottom pocket fastener in an open position, and tools being received within loops and inside the bottom pocket.
Figure 13:
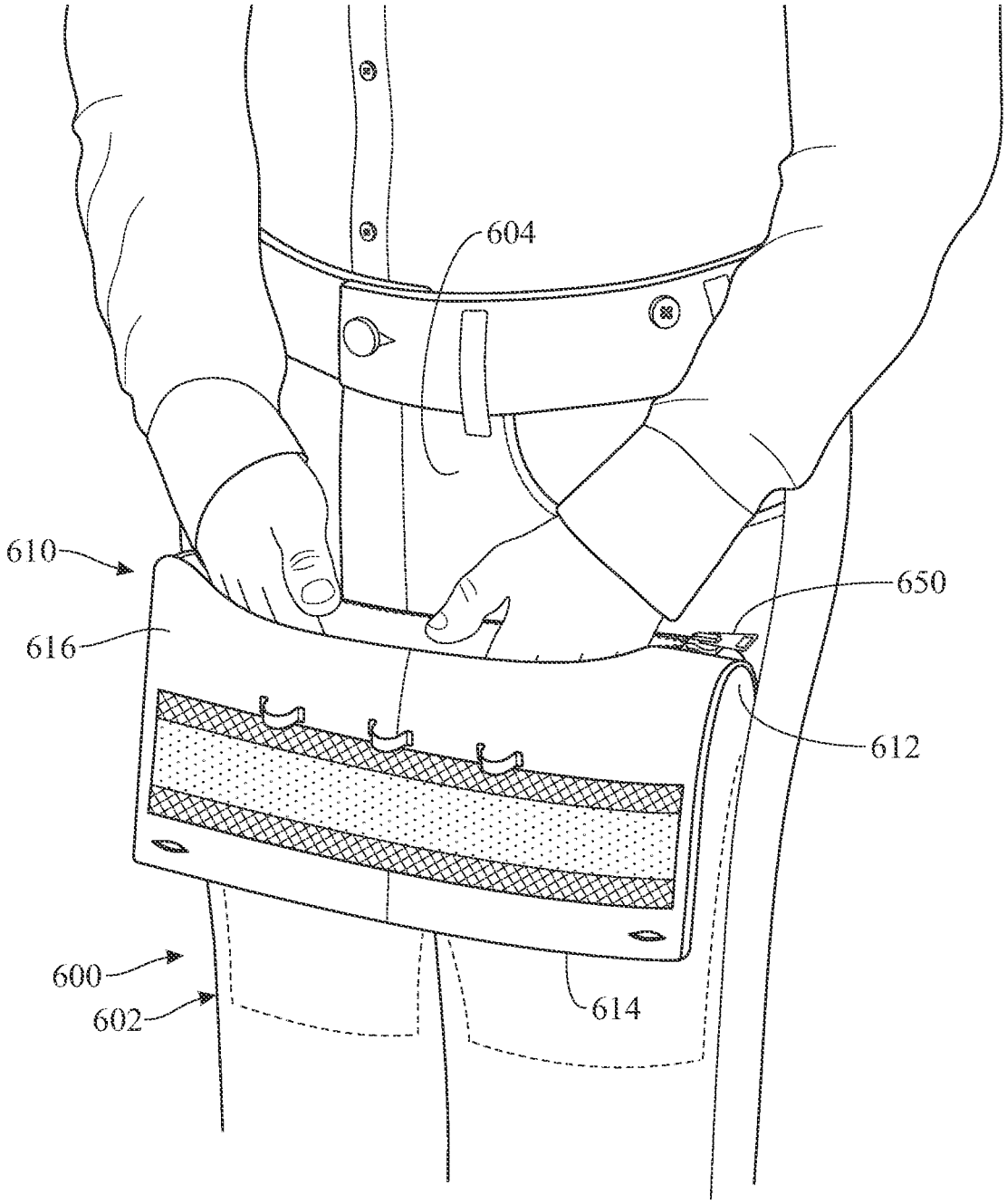
FIG. 13 presents a perspective view of the article of clothing of FIG. 10 in the second configuration, further illustrating a wearer placing their hands inside the bottom pocket.

The article of clothing 600 of the present embodiment is configured to selectively adopt a first configuration, with the cover assembly 610 raised as shown in FIG. 10, and a second configuration, with the cover assembly 610 lowered as shown in FIGS. 11-13.

More specifically, in the first configuration and with reference to FIG. 10, the cover assembly 610 is specifically folded upward about the hinge portion 612, with the free edge 614 of the cover assembly 610 arranged above the hinge portion 612. The cover assembly 610 is arranged generally adjacent to and facing an upper area 604 of the bottom garment 602, and covers the upper area 604. In a non-limiting example, the free edge 614 may be arranged at or near a top or waist edge of the bottom garment 602 which terminates the upper area 604. The cover assembly 610 is secured in place by the at least one fastener 620. In this first configuration, a top pocket 630 is defined between the cover assembly 610 and the upper area 604 of the bottom garment 602. In addition, a top opening 632 is defined by and between the free edge 614 of the cover assembly 602 and the upper area 604 of the bottom garment 602. The top pocket 630 ends in the top opening 632, such that the top opening 632 provides access to the top pocket 630. As shown in the figure, in this first configuration, the article of clothing 600 simultaneously provides several effects or functions. Firstly, the cover assembly 610 conceals the upper area 604 of the bottom garment 602 and an inner side 616 of the cover assembly 610, and exposes an outer side 618 of the cover assembly 610. Secondly, the top pocket 630 provides a space for storing tools and/or inserting the wearer's hands (as shown) such as for warming the hands. As shown, and also similarly to previous embodiments, the top pocket 630 is readily available through the top opening 632 which is defined in this first configuration.

With reference FIGS. 11-13, in the second configuration, the cover assembly 610 is instead folded downward about the hinge portion 612. The free edge 614 of the cover assembly 610 is arranged below the hinge portion 612. The upper area 604 of the bottom garment 602 is exposed. The inner side 616 of the cover assembly 610 is also exposed.

In the second configuration of the article of clothing 600, the cover assembly 610 may provide one or more alternative utilities to those of the first configuration (FIG. 10). In one non-limiting example, the second configuration (FIGS. 11-13) may constitute a 'work configuration', to be adopted while working, while the first configuration (FIG. 9) may constitute a 'non-work configuration', to be adopted before or after work. For instance, before work, a user may wear the article of clothing 600 in the first or non-work configuration, and the cover assembly 610 may generally integrate with the bottom garment 602, and even 'blend in' with the bottom garment 602, especially in the event that the outer side 618 of the cover assembly 610 is manufactured with same, similar or otherwise matching materials and/or colors than the bottom garment 602. In this first configuration, the bottom garment 602 and raised, cover assembly 610 may generally look like an ordinary or conventional pair of pants. When the wearer starts their work schedule, the wearer may disconnect the at least one fastener 620 and lower the cover assembly 610 to switch the article of clothing 600 to the second position, to expose the inner side 616 of the cover assembly 610 and the upper area 604 of the bottom garment 602. In this second or work configuration, a user may for instance wipe their hands on the inner side 616 of the cover assembly 610 and/or the upper area 604 of the bottom garment 602. Alternative or additional uses of the second configuration are described hereinafter. Once the wearer has finished their work day, he or she may raise the cover assembly 610 and re-fasten the at least one fastener 620 to switch the article of clothing 600 to the first or non-work configuration, concealing any soiled surfaces on the inner side 616 of the cover assembly 610 and the upper area 604 of the bottom garment 602, or concealing any features provided on the inner side 616 of the cover assembly 610 and the upper area 604 of the bottom garment 602.

In some embodiments, such as the present article of clothing 600, the cover assembly 610 may be provided on a front side of the bottom garment 602. Alternatively or additionally, a similar cover assembly may be provided on a rear side of the bottom garment 602, similarly to the embodiment of FIG. 6.

Similarly to previous embodiments, the two fasteners 620 of the present embodiment constitute a pair of discrete fasteners which are spaced apart with one another and configured to secure a top left area and a top right area of the cover assembly 610 to the bottom garment 602 when the article of clothing 600 is arranged in the first configuration. The top opening 632 may be formed between the pair of discrete fasteners 620.

Referring again to FIG. 10, in some embodiments, the article of clothing 600 may further include a bottom pocket 640 provided on the bottom garment 602, on the same side as the cover assembly 610. The bottom pocket 640 may be arranged below the top pocket 630 when the article of clothing 600 is arranged in the first configuration, and may optionally extend at least partially along a left leg portion 606 and a right leg portion 608 of the bottom garment 602; for instance, the bottom pocket 640 of the present embodiment includes an upper pocket area 642, and further includes first and second pocket areas 644 and 646, which extend from the upper pocket area 642 into the left and right leg portions 606 and 608 of the bottom garment 602, respectively. As best shown in FIG. 12, the bottom pocket 640 is accessible through a bottom pocket opening 648 which is arranged at the top of the bottom pocket 640. When the article of clothing 600 is arranged in the first or raised configuration, shown in FIG. 10, the cover assembly 610 is folded over and above the bottom pocket opening 648, and the bottom pocket opening 648 is arranged below and facing the top pocket 630 which is formed between the cover assembly 610 and the upper area 604 of the bottom garment 602.

As shown in FIGS. 11-13, the article of clothing 600 may further include at least one bottom pocket fastener 650 configured to selectively open or close the bottom pocket opening 648 and provide or prevent access to the bottom pocket 640 from above. For instance and without limitation, the bottom pocket fastener 650 may include a zipper, as shown, which may extend at least partially along the bottom pocket opening 648, and more preferably along the full length of the bottom pocket opening 648. Alternatively or additionally, the at least one bottom pocket fastener 650 may include at least one of a magnetic fastener, a snap fastener, a button, a hook-type fastener, or another applicable fastener.

As shown in FIGS. 11-13, when the article of clothing 600 is arranged in the second configuration, the at least one bottom pocket fastener 650 is exposed, allowing a user to easily and readily operate the at least one bottom pocket fastener 650 and access the bottom pocket 640. As shown in FIG. 10, when the article of clothing 600 is arranged in the first configuration, the at least one bottom pocket fastener 650 is concealed by the raised cover assembly 610, allowing the at least one bottom pocket fastener 650 to remain private and hidden from others. It should be noted that, in the first configuration, the wearer may still access the bottom pocket fastener 650 and bottom pocket 640 through the top opening 632 and top pocket 630 of the article of clothing 600. Thus, the bottom pocket 640 provides a safe and private storage area for storing valuable items such as, but not limited to, a wallet, keys, access cards, medication, a phone, etc. The wearer may choose to keep the bottom pocket 640 closed while conducting their work, as shown in FIG. 11, to prevent loss or deterioration of the valuable items stored therein while the user carries out his or her tasks. Alternatively, the user may choose to work with the bottom pocket 640 open, as shown in FIG. 12, such as to temporarily hold tools (e.g., wrench 668 and level 670) therein in readily available manner.

As mentioned heretofore, the article of clothing 600 may include at least one functional element on the inner side 616 of the cover assembly 610. In some embodiments, the at least one functional element may include one or more loops 660, configured for the suspending therefrom of one or more tools (e.g., screwdrivers 662, as shown in FIG. 12). The loops 660 may be arranged in spaced-apart configuration with one another. Each loop 660 may be sized smaller than a handle of the tool (e.g., smaller than the screwdriver handle 664) and larger than a remainder of the tool (e.g., wider than the screwdriver shaft 666) to enable the tool to be inserted through the loop 660 with the handle 664 above the loop 660 and retained in place and supported by the loop 660, such that the wearer can readily grasp the tool by the handle 664 and pull the tool out of the loop 660 for use. Alternatively or additionally, the at least one functional element may include one or more light-reflective materials 670. As shown in FIG. 10, the inner side 616 and at least one functional element may be concealed when the article of clothing 600 is arranged in the first configuration. As shown in FIGS. 11-13, the inner side 616 of the cover assembly 610 and the at least one functional element are instead exposed, rendering the functional element usable, when the article of clothing 600 is arranged in the second configuration.

Figure 14:
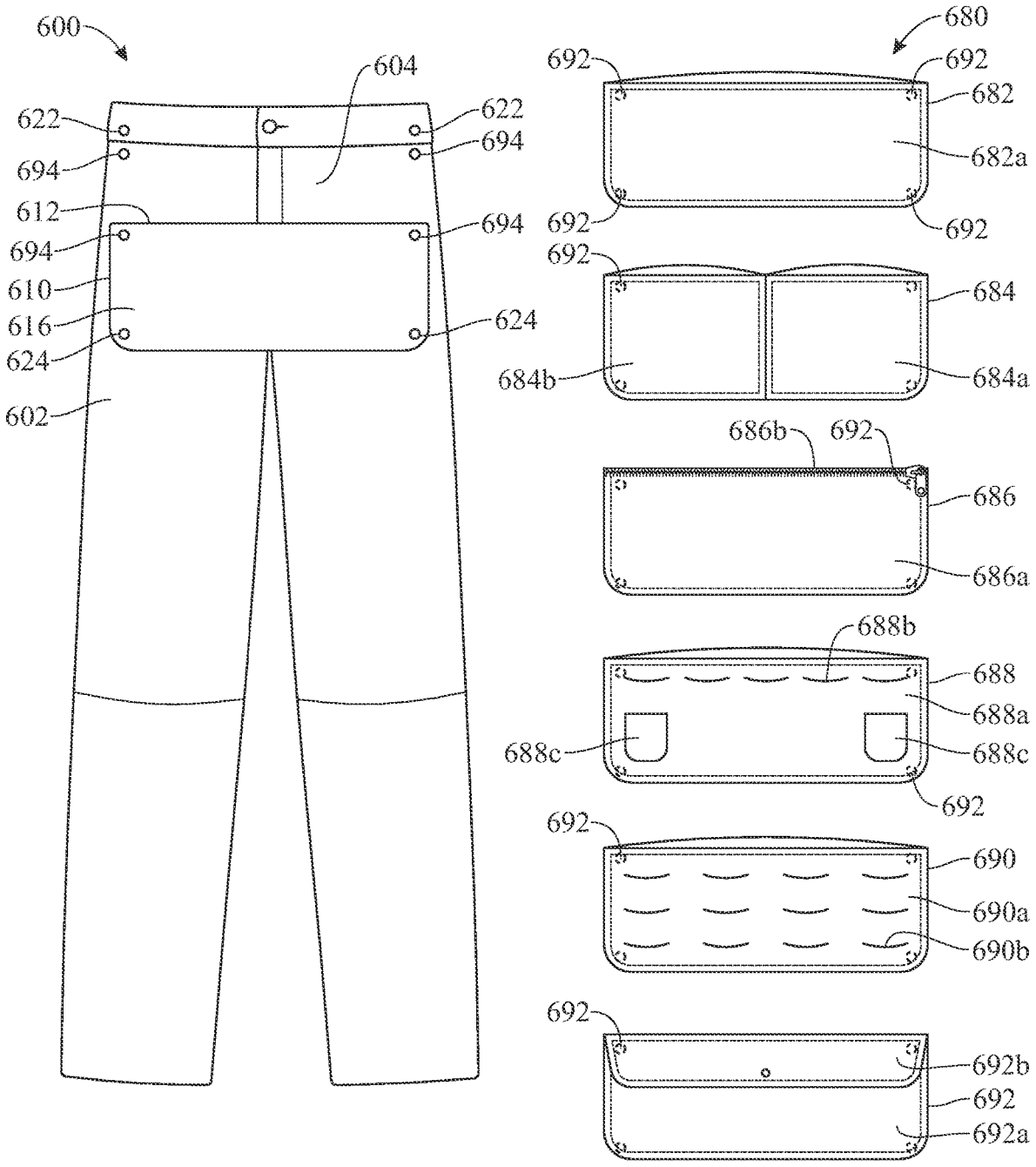
FIG. 14 presents a front elevation view of the article of clothing of FIG. 10 with a plurality of inserts disconnectably connectable to the bottom garment and/or lowered cover assembly.

Referring now to FIG. 14, in some embodiments, the article of clothing 600 may further include at least one insert 680, and more preferably, a plurality of inserts 680. In the non-limiting example shown in the figure, the plurality of inserts 680 includes a first insert 682, a second insert 684, a third insert 686, a fourth insert 688, a fifth insert 690 and a sixth insert 692. Each insert is selectively and disconnectably attachable to one or more of the cover assembly 610 and the upper area 604 of the bottom garment 602 when the article of clothing 600 is arranged in the second configuration.

The article of clothing 600 of claim 15, wherein the at least one insert comprises two or more inserts providing different functional utilities to the article of clothing 600. For example, the first insert 682 of the present embodiment includes a single pocket 682*a*, which may be permanently open; the second insert 684 includes two separate pockets 684*a* and 684*b* in side-by-side configuration, wherein the pockets 684*a* and 684*b* may be permanently open; the third insert 686 may include a single pocket 686*a* which may be closable by a fastener 686*b* such as, but not limited to, a zipper; the fourth insert 688 may include a single pocket 686*a*, which may be permanently open, and a plurality of external, tool-supporting loops 686*b* (shown schematically) and pockets 686*c*; the fifth insert 690 may include a single pocket 690*a*, which may be permanently open, and a plurality of external, tool-supporting loops 690*b* (shown schematically); the sixth insert 692 may include a single pocket 692*a*, which may be closed by a flap 692*b*.

As further shown in FIG. 14, the one or more inserts 680 may be mountable to the bottom garment 602 and/or the cover assembly 610. For instance, in some embodiments, the inserts 680 may be mounted to the at least one fastener 620, i.e. to one or both of the first and second fastener members 622 and 624, when the article of clothing 600 is arranged in the second or lowered configuration. For instance, each insert 680 may include at least one pair of fasteners 692 arranged in horizontal alignment and in spaced-apart configuration with one another and configured to attach to either the first fastener members 622 or the second fastener members 624 of the bottom garment 602 and cover assembly 610, respectively. In some embodiments, such as the present embodiment, each insert 680 more specifically includes two pairs of fasteners 692, one pair arranged over the other pair. The bottom garment 602 and/or cover assembly 610 may include one or more additional fasteners 694 configured to also engage with the fasteners 692 to allow to further select the exact position of the insert 680 on the bottom garment 602 and cover assembly 610, and/or to further customize the number of inserts 680 to be simultaneously attached to the bottom garment 602 and/or cover assembly 610. In preferred embodiments, the inserts 680 are interchangeably attachable to the different fasteners 622, 694 and 624 provided on the bottom garment 602 and cover assembly 610. The one or more additional fasteners 694 may be provided on at least one of the upper area 604 of the bottom garment 602 and an inner side of the cover assembly 610.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. An article of clothing, comprising:

a bottom garment, comprising a front side having an upper area ending in a top, waistline edge;

a cover assembly, provided on the front side of the bottom garment, the cover assembly pivotably affixed to the bottom garment along a hinge portion, the hinge portion arranged oppositely to a free edge of the cover assembly and vertically spaced apart from and below the waistline edge of the upper area of the bottom garment; and at least one fastener; and a bottom pocket provided on the bottom garment, the bottom pocket accessible through a bottom pocket opening; wherein the article of clothing is configured to selectively adopt:

a first configuration, in which the cover assembly is folded upward about the hinge portion, with the free edge of the cover assembly arranged above the hinge portion and generally at the waistline edge of the bottom garment, and in which the cover assembly covers the upper area of the bottom garment and is secured in place by the at least one fastener, and further in which a top pocket is defined between the cover assembly and the upper area of the bottom garment, the top pocket ending in a top opening formed between the free edge of the cover assembly and the bottom garment, the top opening arranged generally at the waistline edge of the upper area of the bottom garment, the top opening and the top pocket configured to receive a pair of hands of a wearer of the article of clothing, the pair of hands arranged generally flat and in side-by-side relationship with one another, and further in which the bottom pocket is arranged below the top pocket and the bottom pocket opening is accessible through the top pocket defined between the cover assembly and the upper area of the bottom garment, and a second configuration, in which the cover assembly is folded downward about the hinge portion, with the free edge of the cover assembly arranged below the hinge portion, and further in which the upper area of the bottom garment is exposed.

2. The article of clothing of claim 1, wherein the at least one fastener is configured to secure at least one of a left side and a right side of the cover assembly to the bottom garment in the first configuration.

3. The article of clothing of claim 1, wherein the at least one fastener comprises a pair of discrete fasteners configured to secure a top left area and a top right area of the cover assembly to the bottom garment in the first configuration, the top opening formed between the pair of discrete fasteners.

4. The article of clothing claim 1, further comprising at least one bottom pocket fastener configured to selectively open or close the bottom pocket opening.

5. The article of clothing of claim 4, wherein the at least one bottom pocket fastener is concealed by the cover assembly when the article of clothing is arranged in the first configuration.

6. The article of clothing of claim 5, wherein the at least one bottom pocket fastener is exposed when the article of clothing is arranged in the second configuration.

7. The article of clothing of claim 6, wherein the at least one bottom pocket fastener comprises a zipper.

8. The article of clothing of claim 1, further comprising at least one functional element on an inner side of the cover assembly, wherein the inner side and the at least one functional element are concealed when the article of clothing is arranged in the first configuration, and further wherein the inner side and the at least one functional element are exposed rendering the functional element usable when the article of clothing is arranged in the second configuration.

9. The article of clothing of claim 8, wherein the at least one functional element comprises one or more loops configured for the suspending therefrom of one or more tools.

10. The article of clothing of claim 8, wherein e at east one functional element comprises one or more light-reflective materials.

11. The article of clothing of claim 1, further comprising at least one insert, wherein each insert is selectively and disconnectably attachable to one or more of the cover assembly and the upper area of the bottom garment when the article of clothing is arranged in the second configuration.

12. The article of clothing of claim 11, wherein the at least one insert comprises two or more inserts providing different functional utilities to the article of clothing.

13. The article of clothing of claim 11, wherein the at least one insert is mountable to the at least one fastener.

14. The article of clothing of claim 11, further comprising one or more additional fasteners provided on at least one of the upper area of the bottom garment and an inner side of the cover assembly, the inner side exposed when the article of clothing is arranged in the second configuration, wherein the at least one insert is attachable to said one or more additional fasteners.

* * * * *